US010871320B2

(12) United States Patent
Kang et al.

(10) Patent No.: US 10,871,320 B2
(45) Date of Patent: Dec. 22, 2020

(54) DEFROSTER AND REFRIGERATOR HAVING SAME

(71) Applicant: LG Electronics Inc., Seoul (KR)

(72) Inventors: Woocheol Kang, Seoul (KR); Kwangsoo Jung, Seoul (KR); Yonggap Park, Seoul (KR); Geunhyung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 133 days.

(21) Appl. No.: 15/747,866

(22) PCT Filed: Aug. 24, 2016

(86) PCT No.: PCT/KR2016/009365

§ 371 (c)(1),
(2) Date: Jan. 26, 2018

(87) PCT Pub. No.: WO2017/034314

PCT Pub. Date: Mar. 2, 2017

(65) Prior Publication Data

US 2019/0011171 A1 Jan. 10, 2019

(30) Foreign Application Priority Data

Aug. 24, 2015 (KR) ..... 10-2015-0119083

(51) Int. Cl.
*F25D 21/08* (2006.01)
*F28D 1/047* (2006.01)
(Continued)

(52) U.S. Cl.
CPC ..... *F25D 21/08* (2013.01); *F25B 39/02* (2013.01); *F25B 39/022* (2013.01); *F25B 47/02* (2013.01);
(Continued)

(58) Field of Classification Search
CPC . F28F 1/28; F28F 2215/04; F28F 1/32; F28D 2021/0071; F28D 1/047;
(Continued)

(56) References Cited

U.S. PATENT DOCUMENTS 1,890,085 A * 12/1932 Hill ..... F25D 21/12 62/82
2,081,479 A * 5/1937 Fink ..... F25D 21/12 62/82
(Continued)

FOREIGN PATENT DOCUMENTS

EP 2541174 A2 * 1/2013
GB 854771 A * 11/1960 ..... F25D 21/12
(Continued)

OTHER PUBLICATIONS

Extended European Search Report in European Application No. 16839603.4, dated Mar. 7, 2019, 8 pages.
(Continued)

*Primary Examiner* — Frantz F Jules
*Assistant Examiner* — Martha Tadesse
(74) *Attorney, Agent, or Firm* — Fish & Richardson P.C.

(57) ABSTRACT

The present invention discloses a defroster comprising: a heating unit having a heater case arranged vertically along an up-down direction on the outside of an evaporator, and a heater disposed vertically in the up-down direction inside the heater case; and a heat pipe respectively connected to an outlet provided at the top side of the heating unit and an inlet provided at the bottom side of the heating unit, and having at least a portion thereof disposed adjacent to the refrigerant pipe of the evaporator so that working fluid heated by the heater moves and transfers heat to the evaporator to remove frost, wherein the heater is configured to be immersed beneath the surface of the working fluid when all the working fluid in the heat pipe is in a liquid state.

19 Claims, 9 Drawing Sheets

(51) Int. Cl.

| | |
|---|---|
| ***F25B 39/02*** | (2006.01) |
| ***F28D 15/02*** | (2006.01) |
| ***F25B 47/02*** | (2006.01) |
| ***F25D 19/00*** | (2006.01) |
| ***F28F 1/32*** | (2006.01) |
| ***F28F 1/28*** | (2006.01) |
| *F28D 21/00* | (2006.01) |

(52) U.S. Cl.
CPC ..... *F25D 19/00* (2013.01); *F25D 19/006* (2013.01); *F28D 15/025* (2013.01); *F28D 15/0266* (2013.01); *F28D 15/0275* (2013.01); *F28F 1/28* (2013.01); *F28F 1/32* (2013.01); *F25D 2400/02* (2013.01); *F28D 1/047* (2013.01); *F28D 2021/0071* (2013.01); *F28F 2215/04* (2013.01)

(58) Field of Classification Search
CPC .... F28D 15/02; F28D 15/0275; F28D 15/025; F28D 15/0266; F25D 2400/02; F25D 21/12; F25D 21/06; F25D 19/00; F25D 19/006; F25D 21/08; F24F 11/41; F25B 47/02; F25B 39/022; F25B 39/02
See application file for complete search history.

(56) References Cited

U.S. PATENT DOCUMENTS

| | | | | | |
|---|---|---|---|---|---|
| 2,513,823 | A * | 7/1950 | Shreve | F25D 21/002 | 62/267 |
| 2,526,032 | A * | 10/1950 | La Porte | F25D 21/12 | 62/81 |
| 2,553,657 | A * | 5/1951 | La Porte | F25D 21/12 | 62/82 |
| 2,631,442 | A * | 3/1953 | Melcher | F25D 21/12 | 62/267 |
| 2,652,697 | A * | 9/1953 | Pellegrini | F25D 21/12 | 62/156 |
| 4,369,350 | A * | 1/1983 | Kobayashi | F25D 21/08 | 219/201 |
| 2005/0081548 | A1* | 4/2005 | Lee | F25D 21/12 | 62/277 |

FOREIGN PATENT DOCUMENTS

| | | | | |
|---|---|---|---|---|
| JP | 1993346284 | | 12/1993 | |
| JP | 08-303932 | | 11/1996 | |
| JP | 1996303932 | | 11/1996 | |
| KR | 10-2001-0047410 | | 6/2001 | |
| KR | 20030068931 | A * | 3/2003 | |
| KR | 20030068931 | A * | 8/2003 | F25B 39/02 |
| KR | 1020030068931 | | 8/2003 | |
| KR | 10-2004-0014137 | | 2/2004 | |
| KR | 100469322 | | 2/2005 | |
| KR | 100962979 | | 6/2010 | |
| KR | 20110121862 | A * | 11/2011 | |
| KR | 10-2013-0016999 | | 2/2013 | |

OTHER PUBLICATIONS

International Search Report in International Application No. PCT/KR2016/009365, dated Dec. 2, 2016, 4 pages (with English translation).

* cited by examiner

DEFROSTER AND REFRIGERATOR HAVING SAME

CROSS-REFERENCE TO RELATED APPLICATION

This application is the National Stage filing under 35 U.S.C. 371 of International Application No. PCT/KR2016/009365, filed on Aug. 24, 2016, which claims the benefit of earlier filing date and right of priority to Korean Application No. 10-2015-0119083, filed on Aug. 24, 2015, the contents of which are all hereby incorporated by reference herein in their entirety.

TECHNICAL FIELD

The present invention relates to a defroster for removing frost generated on an evaporator provided at a refrigerating cycle, and a refrigerator having the same.

BACKGROUND ART

An evaporator provided at a refrigerating cycle lowers a surrounding temperature by using cold air generated as a refrigerant which flows on a cooling pipe circulates. In this process, if there is a temperature difference from the surrounding air, moisture in the air is condensed to be frozen on the surface of the cooling pipe.

In order to remove frost on the evaporator, a defrosting method using an electric heater has been conventionally used.

Recently, a defroster using a heat pipe as a heat emitting means has been developed. As a related technique, Korean Registration Patent No. 10-0469322 "Evaporator" has been disclosed.

Such a heat pipe type defroster disclosed in the above patent has a configuration that a heating unit is vertically arranged in an up-down direction of an evaporator, and a working fluid is filled only at a bottom part of the heating unit. In case of using such a small amount of working fluid, an evaporation speed of the working fluid may be increased through a rapid heating. However, in this case, a heater provided in the heating unit may be overheated.

In case of a defroster where a heating unit is horizontally arranged in right and left directions of an evaporator, a lower side horizontal pipe of a heat pipe constitutes the evaporator of a high temperature by being connected to an outlet of the heating unit. This may allow a lower side cooling pipe to be defrosted smoothly.

However, in case of a defroster disclosed in the above patent where a heating unit is vertically arranged in an up-down direction of an evaporator, a lower side horizontal pipe of a heat pipe constitutes a condensation part of a low temperature connected to an inlet of the heating unit. This may cause a lower side cooling pipe not to be defrosted smoothly.

DISCLOSURE OF THE INVENTION

Therefore, an object of the present invention is to provide a defroster where a heating unit is vertically disposed in an up-down direction of an evaporator, the defroster having a structure where the heating unit can be safely operated without being overheated.

Another object of the present invention is to provide a defroster where a heating unit is vertically disposed in an up-down direction of an evaporator, the defroster having a structure where a cooling pipe below the evaporator can be smoothly defrosted.

To achieve these and other advantages and in accordance with the purpose of the present invention, as embodied and broadly described herein, there is provided a defroster, comprising: a heating unit including a heater case vertically arranged in an up-down direction of an evaporator outside the evaporator, and including a heater vertically arranged in the heater case in the up-down direction at least partially; and a heat pipe connected to each of an outlet provided at an upper side of the heating unit and an inlet provided at a lower side of the heating unit, and arranged near a cooling pipe of the evaporator at least partially such that a working fluid heated by the heater transfers heat to the evaporator for removal of frost while moving, wherein when all of the working fluid inside the heat pipe is in a liquid state, the heater is configured to be positioned below a surface of the working fluid.

The present invention discloses first to third embodiments of the defroster having the above structure basically.

First Embodiment

The heater includes: an active heating portion configured to emit heat actively so as to heat the working fluid; and a passive heating portion provided below the active heating portion and heated to a lower temperature than the active heating portion. The inlet of the heating unit is positioned to correspond to the passive heating portion, such that the working fluid which returns after moving along the heat pipe is introduced into the passive heating portion.

The outlet of the heating unit is positioned to correspond to the active heating portion, or is positioned above the active heating portion.

The heat pipe includes: an evaporation part connected to the outlet of the heating unit, and arranged to correspond to the cooling pipe of the evaporator to transfer heat to the cooling pipe of the evaporator; and a condensation part extended from the evaporation part, arranged below a lowermost-row cooling pipe of the evaporator, and connected to the inlet of the heating unit.

The condensation part includes at least two horizontal pipes disposed below the lowermost-row cooling pipe of the evaporator.

A lower end of the heating unit is arranged near the lowermost-row cooling pipe of the evaporator.

The condensation part includes a return part upward extended from a lowermost-row horizontal pipe of the condensation part to the inlet of the heating unit.

SECOND EMBODIMENT

The heater includes: an active heating portion configured to emit heat actively so as to heat the working fluid; and a passive heating portion provided below the active heating portion and heated to a lower temperature than the active heating portion. The inlet of the heating unit is positioned to correspond to the passive heating portion, such that the working fluid which returns after moving along the heat pipe is introduced into the passive heating portion.

The outlet of the heating unit is positioned to correspond to the active heating portion, or is positioned above the active heating portion.

The heat pipe includes: an evaporation part connected to the outlet of the heating unit, and arranged to correspond to the cooling pipe of the evaporator to transfer heat to the cooling pipe of the evaporator; and a condensation part extended from the evaporation part, arranged below a lowermost-row cooling pipe of the evaporator, and connected to the inlet of the heating unit.

The condensation part includes at least two horizontal pipes disposed below the lowermost-row cooling pipe of the evaporator.

A lower part of the heating unit is arranged below the lowermost-row cooling pipe of the evaporator.

A lower end of the heating unit is arranged near the lowermost-row horizontal pipe of the condensation part.

An upper end of the heating unit is positioned below a cooling pipe formed directly above the lowermost-row cooling pipe of the evaporator.

Third Embodiment

The lowermost-row horizontal pipe of the heat pipe is arranged near the lowermost-row cooling pipe of the evaporator. And an upper end of the heating unit is positioned below a cooling pipe formed directly above the lowermost-row cooling pipe of the evaporator.

The heater includes an active heating portion configured to emit heat actively so as to heat the working fluid, and the inlet of the heating unit is positioned to correspond to the active heating portion.

The heater further includes a passive heating portion provided below the active heating portion and heated to a lower temperature than the active heating portion, and at least part of the passive heating portion is positioned outside the heater case.

To achieve these and other advantages and in accordance with the purpose of the present invention, as embodied and broadly described herein, there is also provided a refrigerator, comprising: a refrigerator body; an evaporator installed at the refrigerator body, and configured to cool a fluid by depriving surrounding evaporation heat; and a defroster configured to remove frost on the evaporator.

In addition, to achieve these and other advantages and in accordance with the purpose of the present invention, as embodied and broadly described herein, there is provided a defroster, comprising: a heating unit including a heater case vertically arranged in an up-down direction of an evaporator outside the evaporator, and including a heater vertically arranged in the heater case in the up-down direction at least partially; and a heat pipe connected to each of an outlet provided at an upper side of the heating unit and an inlet provided at a lower side of the heating unit, and arranged near a cooling pipe of the evaporator at least partially such that a working fluid heated by the heater transfers heat to the evaporator for removal of frost while moving, wherein the heat pipe includes: an evaporation part connected to the outlet of the heating unit, and arranged to correspond to the cooling pipe of the evaporator to transfer heat to the cooling pipe of the evaporator; and a condensation part extended from the evaporation part, arranged below a lowermost-row cooling pipe of the evaporator, and connected to the inlet of the heating unit.

The condensation part includes at least two horizontal pipes disposed below the lowermost-row cooling pipe of the evaporator.

A lower end of the heating unit is arranged near the lowermost-row cooling pipe of the evaporator.

The condensation part includes a return part upward extended from a lowermost-row horizontal pipe of the condensation part to the inlet of the heating unit.

A lower part of the heating unit is arranged below the lowermost-row cooling pipe of the evaporator.

A lower end of the heating unit is arranged near the lowermost-row horizontal pipe of the condensation part.

An upper end of the heating unit is positioned below a cooling pipe formed directly above the lowermost-row cooling pipe of the evaporator.

The evaporator includes: a cooling pipe which forms a plurality of rows by being repeatedly bent in a zigzag manner; a plurality of cooling fins fixed to the cooling pipe, and spaced apart from each other with a predetermined 20 interval therebetween in an extended direction of the cooling pipe; and a plurality of supporting plates configured to support both ends of each row of the cooling pipe.

In the present invention, in the defroster where the heating unit is vertically disposed in an up-down direction of the evaporator, when all of the working fluid inside the heat pipe is in a liquid state, the heater is configured to be immersed below the surface of the working fluid. This may allow a defrosting operation to be performed safely without overheating the heating unit.

If the low-temperature condensation part of the heat pipe is further provided below the lowermost-row cooling pipe of the evaporator by at least two row, only the high-temperature evaporation part is used to defrost the evaporator. This may allow the lower side cooling pipe to be defrosted smoothly.

Under the above structure, at least part of the heating unit may be arranged below the evaporator. Preferably, a lower end of the heating unit may be arranged near the lowermost-row horizontal pipe of the heat pipe. In this case, the amount of the working fluid may be reduced, and a temperature of the lowermost-row horizontal pipe of the heat pipe may be increased to a value where defrosting can be performed.

Further, at least part of the passive heating portion provided below the active heating portion of the heater may be exposed to outside of the heater case. In this case, the amount of the working fluid may be reduced, and a temperature of the lowermost-row horizontal pipe of the heat pipe may be increased to a value where defrosting can be performed. Further, it is not required to install the heat pipe below the lowermost-row cooling pipe of the evaporator by at least two rows. This may allow the defroster to have a small volume and an enhanced efficiency.

MODES FOR CARRYING OUT THE PREFERRED EMBODIMENTS

Description will now be given in detail of preferred configurations of the present invention, with reference to the accompanying drawings. The same or equivalent components will be provided with the same reference numbers, and description thereof will not be repeated.

Figure 1:
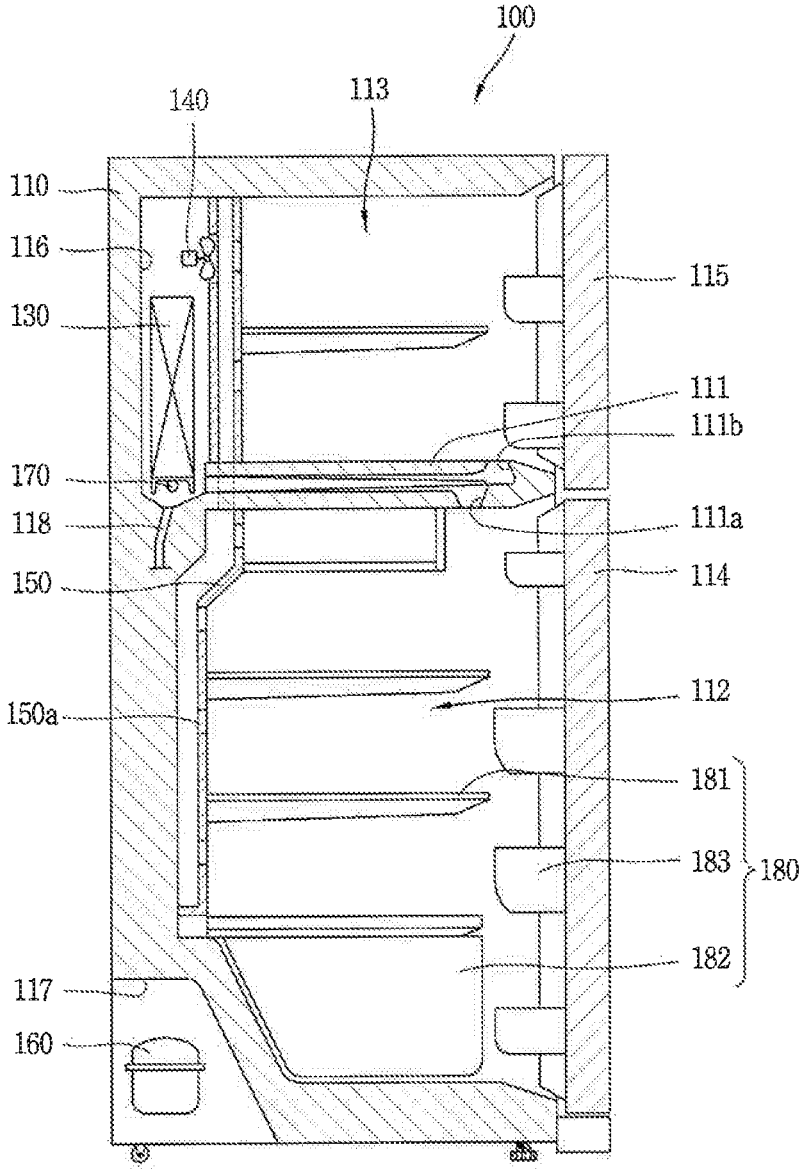
FIG. 1 is a longitudinal sectional view schematically showing a configuration of a refrigerator according to an embodiment of the present invention.

FIG. 1 is a longitudinal sectional view schematically showing a configuration of a refrigerator 100 according to an embodiment of the present invention.

The refrigerator 100 is an apparatus for storing food items stored therein at a low temperature, by using cold air generated by a refrigerating cycle where processes of compression-condensation-expansion-evaporation are consecutively performed.

As shown, a refrigerator body 110 is provided therein with a storage space for storing food items. The storage space may be partitioned by a partition wall 111, and may be divided into a refrigerating chamber 112 and a freezing chamber 113 according to a setting temperature.

In this embodiment, illustrated is a 'top mount type refrigerator' where the freezing chamber 113 is provided above the refrigerating chamber 112. However, the present invention is not limited to this. That is, the present invention may be also applied to a 'side by side type refrigerator' where a refrigerating chamber and a freezing chamber are arranged right and left, or a 'bottom freezer type refrigerator' where a refrigerating chamber is provided at an upper side and a freezing chamber is provided at a lower side, may be A door is connected to the refrigerator body 110 to open and close a front opening of the refrigerator body 110. In the drawings, a refrigerating chamber door 114 and a freezing chamber door 115 are configured to open and close front surfaces of the refrigerating chamber 112 and the freezing chamber 113, respectively. The door may be variously implemented as a rotation type door rotatably connected to the refrigerator body 110, a drawer type door slidably connected to the refrigerator body 110, etc.

At least one accommodation unit 180 (e.g., a shelf 181, a tray 182, a basket 183, etc.) for efficient utilization of the storage space inside the refrigerator body 110 is provided at the refrigerator body 110. For instance, the shelf 181 and the tray 182 may be installed in the refrigerator body 110, and the basket 183 may be installed in the door 114 connected to the refrigerator body 110.

A cooling chamber 116 having an evaporator 130 and a blower 140 is provided at a rear side of the freezing chamber 113. A refrigerating chamber feedback duct 111*a* and a freezing chamber feedback duct 111*b*, configured to suck and return air inside the refrigerating chamber 112 and the freezing chamber 113 to the cooling chamber 116, are provided at the partition wall 111. A cold air duct 150, communicated with the freezing chamber 113 and having a plurality of cold air discharge openings 150*a* on a front surface thereof, is installed at a rear side of the refrigerating chamber 112.

A mechanical chamber 117 is provided at a lower side of a rear surface of the refrigerator body 110, and a compressor 160, a condenser (not shown), etc. are provided in the mechanical chamber 117.

Air inside the refrigerating chamber 112 and the freezing chamber 113 is sucked into the cooling chamber 116 through the refrigerating chamber feedback duct 111*a* and the freezing chamber feedback duct 111*b* of the partition wall 111, by the blower 140 of the cooling chamber 116, thereby being heat-exchanged with the evaporator 130. Then, the air is discharged to the refrigerating chamber 112 and the freezing chamber 113 through the cold air discharge openings 150*a* of the cold air duct 150. These processes are repeatedly performed. Here, frost is generated on the surface of the evaporator 130 due to a temperature difference from circulation air re-introduced through the refrigerating chamber feedback duct 111*a* and the freezing chamber feedback duct 111*b*.

In order to remove such frost, a defroster 170 is provided at the evaporator 130, and water removed by the defroster 170 (i.e., defrosting water) is collected at a defrosting water container (not shown) formed at a lower side of the refrigerator body 110, through a defrosting water discharge pipe 118.

Hereinafter, will be explained the novel type of defroster 170 capable of reducing a power consumption at the time of defrosting, and capable of enhancing a heat exchange rate.

Figure 2:
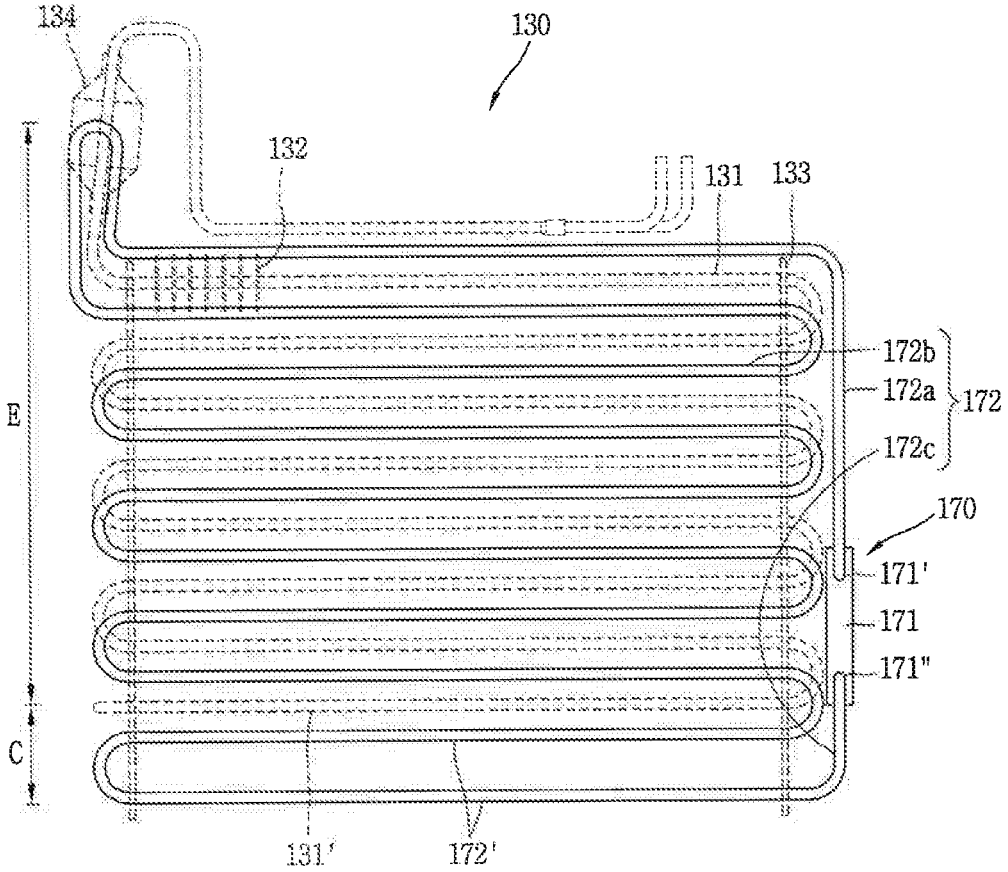
FIG. 2 is a view conceptually showing a first embodiment of a defroster applied to the refrigerator of FIG. 1.
Figure 3:
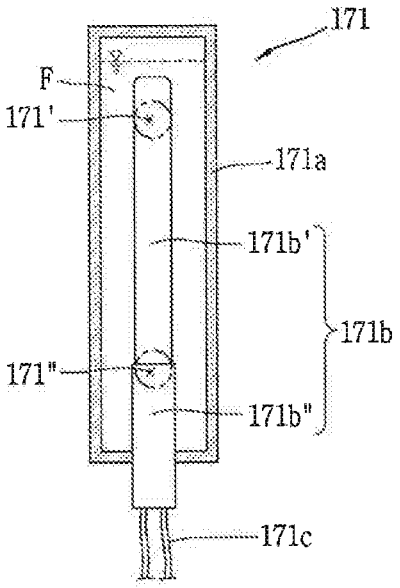
FIG. 3 is a sectional view of a heating unit shown in FIG. 2.

FIG. 2 is a view conceptually showing a first embodiment of the defroster 170 applied to the refrigerator of FIG. 1, and FIG. 3 is a sectional view of a heating unit 171 shown in FIG. 2.

Figure 4:
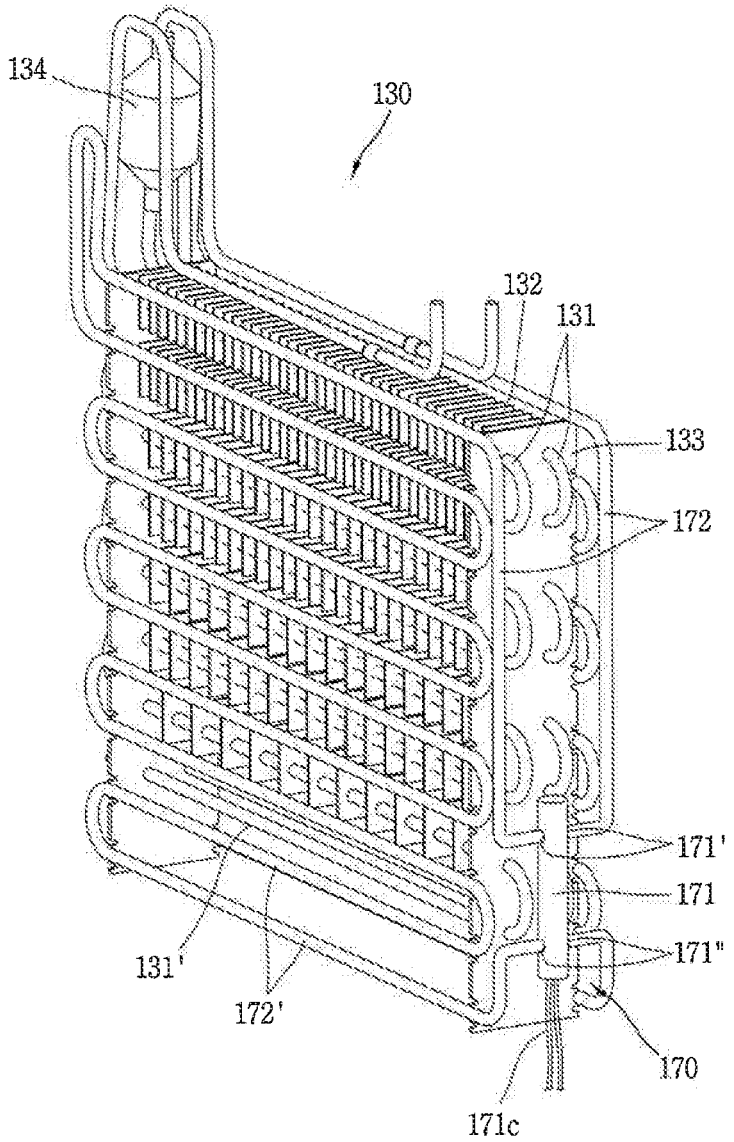
FIG. 4 is a view showing a detailed embodiment of the defroster shown in FIG. 2.

Referring to FIGS. 2 and 3, the evaporator 130 includes a cooling pipe 131, a plurality of cooling fins 132, and a plurality of supporting plates 133. In the drawings, for convenience, a part of the cooling fins 132 was omitted. For reference, a detailed configuration of the evaporator 130 is shown in FIG. 4.

The cooling pipe 131 forms a plurality of rows by being repeatedly bent in a zigzag manner, and has therein a refrigerant. The cooling pipe 131 may be configured by a combination of a horizontal pipe portion and a bent pipe portion. The horizontal pipe portions are disposed to be parallel to each other up and down, and are configured to penetrate the cooling fins 132. And the bent pipe portion is configured to connect an end part of the upper horizontal pipe portion with an end part of the lower horizontal pipe portion, for internal communication with each other.

The cooling pipe 131 may be formed to have a single line, or may be formed to have a plurality of lines in back and forth directions of the evaporator 130.

The plurality of cooling fins 132 are disposed at the cooling pipe 131 in a spaced manner with a predetermined interval therebetween, in an extended direction of the cooling pipe 131. The cooling fins 132 may be formed as a plate body formed of an aluminum material. And the cooling pipe 131 may be expanded when inserted into insertion holes of the cooling fins 132, thereby being firmly fitted into the insertion holes.

The plurality of supporting plates 133 are provided at both sides of the evaporator 130, and each of the supporting plates 133 is vertically extended in an up-down direction to support bent end parts of the cooling pipe 131. An insertion groove for fitting a heat pipe 172 to be explained later thereinto is formed at each of the supporting plates 133.

The defroster 170 is configured to remove frost generated from the evaporator 130, and is installed at the evaporator 130 as shown. The defroster 170 includes a heating unit 171 and a heat pipe 172.

The heating unit 171 is electrically connected to a controller (not shown), and is formed to generate heat at the time of receiving an operation signal from the controller. For instance, the controller may be configured to apply an operation signal to the heating unit 171 at each preset time interval, or to apply an operation signal to the heating unit 171 when a sensed temperature of the cooling chamber 116 is lower than a preset temperature.

Referring to FIG. 3, the heating unit 171 will be explained in more detail. The heating unit 171 includes a heater case 171*a* and a heater 171*b*.

The heater case 171*a* is extended in one direction, and is vertically disposed outside the evaporator 130 in an up-down direction. For instance, the heater case 171*a* may be disposed outside one supporting plate 133 in parallel to the supporting plate 133 with a predetermined interval. The heater case 171*a* may be arranged at one side of the evaporator 130 where an accumulator 134 is positioned, or may be arranged at another side, the opposite side. The heater case 171*a* may be formed to have a cylindrical shape or a square pillar shape.

The heater case 171*a* is connected to both ends of the heat pipe 172, thereby forming a closed loop type flow path where a working fluid (F) can circulate, together with the heat pipe 172.

More specifically, an outlet 171' communicated with one end of the heat pipe 172 is formed at an upper side of the heater case 171*a* (e.g., an upper surface of the heater case 171*a* or an outer circumferential surface adjacent to the upper surface). The outlet 171' means an opening through which the evaporated working fluid (F) is discharged to the heat pipe 172.

An inlet 171" communicated with a return part 172*b* is formed at a lower side of the heater case 171*a* (e.g., a bottom surface of the heater case 171*a* or an outer circumferential surface adjacent to the bottom surface). The inlet 171" means an opening through which the working fluid (F) condensed while passing through the heat pipe 172 is collected to the heating unit 171.

The heater 171*b* is accommodated in the heater case 171*a*, and has an extended shape in a lengthwise direction of the heater case 171*a*. That is, the heater 171*b* is vertically arranged in an up-down direction of the evaporator 130.

The heater 171*b* may be inserted through a bottom surface of the heater case 171*a*, thereby being fixed to the heater case 171*a*. That is, a lower end of the heater 171*b* may be sealed and fixed to a bottom part of the heater case 171*a*, and an upper end of the heater 171*b* may be extended toward an upper part of the heater case 171*a*.

The heater 171*b* is spaced apart from an inner circumferential surface of the heater case 171*a* with a preset interval. Under this arrangement, a ring-shaped space having a ring-shaped gap is formed between an inner circumferential surface of the heater case 171*a* and an outer circumferential surface of the heater 171*b*.

A power source portion 171*c* is connected to the heater 171*b* so as to supply power to a coil (not shown) provided in the heater 171*b*. A part of the heater 171*b* where the coil is formed constitutes an active heating portion for evaporating a working fluid by being heated to a high temperature. The active heating portion will be explained later.

The heat pipe 172 is connected to each of an outlet 171' provided at an upper side of the heating unit 171 and an inlet 171" provided at a lower side of the heating unit 171, and has therein a predetermined working fluid (F). As the working fluid (F), a general refrigerant (e.g., R-134a, R-600a, etc.) may be used.

At least part of the heat pipe 172 is arranged near the cooling pipe 131 of the evaporator 130, such that the working fluid (F) heated by the heating unit 171 transfers heat to the evaporator 130 while passing through the heat pipe 172, for removal of frost.

As the working fluid (F) filled in the heat pipe 172 is heated to a high temperature by the heating unit 171, the working fluid (F) flows by a pressure difference to move along the heat pipe 172. More specifically, the high-temperature working fluid (F) heated by the heater 171*b* and discharged to the outlet 171' transfers heat to the cooling pipe 131 of the evaporator 130, while moving along the heat pipe 172. The working fluid (F) is cooled through such a heat exchange process, and is introduced into the inlet 171". The cooled working fluid (F) is re-heated by the heater 171*b* and then is discharged to the outlet 171', thereby repeatedly performing the above processes. Through such a circulation method, the cooling pipe 131 is defrosted.

The heat pipe 172 may have a repeatedly bent form (a zigzag form) like the cooling pipe 131. For this, the heat pipe 172 may include a vertical extended portion 172*a*, a heat emitting portion 172*b*, and a return portion 172*c*.

The vertical extended portion 172*a* is connected to the outlet 171' of the heating unit 171, and is vertically arranged in an up-down direction of the evaporator 130. The vertical extended portion 172*a* is extended up to an upper part of the evaporator 130, in an arranged state outside one supporting plate 133 in parallel to the supporting plate 133 with a predetermined interval.

The heat emitting portion 172*b* is extended in a zigzag form along the cooling pipe 131 of the evaporator 130. The heat emitting portion 172*b* may be implemented by a combination of a plurality of horizontal pipes which form rows, and a connection pipe bent in a U-shape so as to connect the plurality of horizontal pipes to each other in a zigzag form.

The heat emitting portion 172*b* may be extended up to a position adjacent to the accumulator 134, In order to remove frost on the accumulator 134. As shown, the heat emitting portion 172*b* may be upward extended towards the accumulator 134, and then may be downward bent and extended towards the cooling pipe 131.

If the heating unit 171 is arranged at one side of the evaporator 130 where the accumulator 134 is positioned, the vertical extended portion 172*a* may be upward extended up to a position adjacent to the accumulator 134. Then, the vertical extended portion 172*a* may be downward bent and extended towards the cooling pipe 131 to thus be connected to the heat emitting portion 172*b*.

The return portion 172*c* is connected to a lowermost-row horizontal pipe of the heat pipe 172, and is upward extended up to the inlet 171" of the heating unit 171.

As aforementioned, the heater 171*b* is accommodated in the heater case 171*a*, and is extended in a lengthwise direction of the heater case 171*a*. And a predetermined working fluid (F) is filled in the heating unit 171 and the heat pipe 172.

When all of the working fluid (F) is in a liquid state (when the heater 171*b* is not operated), If an upper end of the heater 171*b* is exposed above a surface of the working fluid (F), the heater 171*b* may be operated. In this case, the upper end of the heater 171*b* may have its temperature increased drastically, unlike the remaining parts immersed in the working fluid (F).

If this state is maintained, the upper end of the heater 171*b* may be overheated to cause a lethal damage (e.g., fire) to the defroster 170. Further, the heated working fluid (F) may backflow to the return portion of the heat pipe 172.

In order to prevent this, the working fluid (F) is filled in the heater case 171*a* so as to form the surface at a position higher than the upper end of the heater 171*b*, in a liquid state (when the heater 171*b* is not operated). That is, the heater 171*b* is configured to be immersed below the surface of the working fluid (F).

Under such a configuration, the working fluid (F) is heated in a state that the heater 171*b* is immersed below the surface of the working fluid (F) which is in a liquid state. As a result, the working fluid (F) evaporated by heating may be sequentially transferred to the heat pipe 172. This may implement a smooth circulation flow, and may prevent the heating unit 171 from being overheated.

Referring to FIG. 3, the heater may be categorized into an active heating portion 171*b*' and a passive heating portion 171*b*" according to whether it emits heat actively or passively.

More specifically, the active heating portion 171*b*' is configured to emit heat actively. The working fluid (F) in a liquid state may be heated by the active heating portion 171*b*' to thus have a phase change into a high-temperature gaseous state.

The passive heating portion 171*b*" is provided below the active heating portion 171*b*'. The passive heating portion 171*b*" cannot emit heat spontaneously, and is heated to a low temperature by receiving heat from the active heating portion 171*b*'. The passive heating portion 171*b*" causes the working fluid (F) which is in a liquid state to have a temperature increase a little. But the passive heating portion 171*b*" does not have a high temperature high enough to make the working fluid (F) have a phase change into a gaseous state.

Under the above structure, the inlet 171" of the heating unit 171 is positioned to correspond to the passive heating portion 171*b*", such that the working fluid (F) which returns after moving along the heat pipe 172 is introduced into the passive heating portion 171*b*". FIG. 3 shows that the inlet 171" of the heating unit 171 is formed on an outer circumference of a part of the heater case 171*a* which encloses the passive heating portion 171*b*".

The outlet 171' of the heating unit 171 is positioned to correspond to the active heating portion 171*b*', or is positioned above the active heating portion 171*b*'. FIG. 3 shows that the outlet 171' of the heating unit 171 is formed on an outer circumference of a part of the heater case 171*a* which encloses the active heating portion 171*b*'.

The heat pipe 172 may be divided into an evaporation part (E) of a high temperature and a condensation part (C) of a low temperature, according to a state of the working fluid (F) which circulates.

The evaporation part (E) is a part where the working fluid (F) moves in a high-temperature gas state or in a high-temperature gas/liquid state, which has a temperature where the cooling pipe 131 can be defrosted. Structurally, the evaporation part (E) is connected to the outlet 171' of the heating unit 171, and is arranged to correspond to the cooling pipe 131 of the evaporator 130 to transfer heat to the cooling pipe 131 of the evaporator 130.

On the other hand, the condensation part (C) is a part where the working fluid (F) moves in a low-temperature liquid state, which has a lower temperature than a temperature where the cooling pipe 131 can be defrosted. Thus, even if the condensation part (C) is arranged near the cooling pipe 131, the cooling pipe 131 cannot be smoothly defrosted.

The heat pipe 172 is extended in a zigzag form in a downward direction. Thus, if the heat pipe 172 is arranged to correspond to the cooling pipe 131, the condensation part (C) is arranged near the cooling pipe 131. This means that the lower side cooling pipe 131 cannot be smoothly defrosted.

In order to solve this, the condensation part (C) is extended from the evaporation part (E), and is arranged below a lowermost-row cooling pipe 131' of the evaporator 130. The condensation part (C) includes at least two horizontal pipes 172' disposed below the lowermost-row cooling pipe 131' of the evaporator 130. FIG. 2 shows a structure that the heat pipe 172 constitutes the condensation part (C) by further including two rows below the lowermost-row cooling pipe 131' of the evaporator 130.

In such a case that the low-temperature condensation part (C) of the heat pipe 172 is arranged below the lowermost-row cooling pipe 131' of the evaporator 130, only the high-temperature evaporation part (E) is used to defrost the evaporator 130. This may allow the lower side cooling pipe 131 to be defrosted smoothly.

Under the above structure, a lower end of the heating unit 171 is arranged near the lowermost-row cooling pipe 131'. Accordingly, the return part is upward extended in a bent shape, from the lowermost-row horizontal pipe of the condensation part (C) to the inlet 171" of the heating unit 171. That is, the return part is communicated with each of the lowermost-row horizontal pipe of the condensation part (C) and the inlet 171" of the heating unit 171, thereby forming a flow path along which the condensed working fluid (F) can be collected.

The return part of a bent shape has a large flow resistance, which is advantageous in preventing a backflow of the working fluid (F) which returns to the inlet 171" of the heating unit 171.

FIG. 4 is a view showing a detailed embodiment of the defroster 170 shown in FIG. 2.

Referring to FIG. 4, a cooling pipe 131 forms a plurality of rows by being repeatedly bent in a zigzag form. The cooling pipe 131 may be formed as a copper pipe, and has therein a refrigerant.

In this embodiment, the cooling pipe 131 is configured to have a first cooling pipe and a second cooling pipe formed on a front surface and a rear surface of an evaporator 130, respectively, in order to implement two lines. However, the cooling pipe 131 may be configured to implement a single line.

A plurality of cooling fins 132 are formed at the cooling pipe 131, in a spaced manner from each other with a predetermined interval therebetween, in an extended direction of the cooling pipe 131. The cooling fins 132 may be formed as a plate body formed of an aluminum material. And the cooling pipe 131 may be expanded when inserted into insertion holes of the cooling fins 132, thereby being firmly fitted into the insertion holes.

A heat pipe 172 forms a plurality of rows by being repeatedly bent in a zigzag form. The heat pipe 172 may be formed as a copper pipe, and a working fluid (F) is filled in the heat pipe 172.

In this embodiment, the heat pipe 172 includes a first heat pipe and a second heat pipe, and the first and second heat pipes are arranged outside the first and second cooling pipes, respectively. Alternatively, the heat pipe 172 may be configured to implement a single line.

The heat pipe 172 may be configured to be accommodated between the cooling fins 132 fixed to each row of the cooling pipe 131. Under such a structure, the heat pipe 172 is arranged between the respective rows of the cooling pipe 131. In this case, the heat pipe 172 may be configured to contact the cooling fins 132.

The heat pipe 172 may be installed to penetrate the plurality of cooling fins 132. That is, the heat pipe 172 may be expanded when inserted into the insertion holes of the cooling fins 132, thereby being firmly fitted into the insertion holes. Under such a structure, heat may be transferred to the cooling pipe 131 through the cooling fins 132. This is advantageous in the aspect of heat transfer efficiency.

A heating unit 171 is vertically arranged outside one supporting plate 133 in an up-down direction of the evaporator 130, In a spaced manner from the one supporting plate 133 with a predetermined gap. As shown, a part of the heating unit 171 may be accommodated between first and second cooling pipes 131 which are protruded from the one supporting plate 133 and bent.

The heating unit 171 includes a heater case 171*a* connected to both ends of the heat pipe 172 and forming a closed loop where the working fluid (F) can circulate, and a heater 171*b* configured to heat the working fluid (F).

In this embodiment where the heat pipe 172 is configured as the first and second heat pipes, the heat case 171*a* includes first and second outlets 171' for discharging the heated working fluid (F) to the first and second heat pipes, and first and second inlets 171" for introducing the cooled working fluid (F) from the first and second heat pipes.

The first and second outlets 171' are formed on an outer circumferential surface of an upper side of the heater case 171*a*, and are connected to one ends of the first and second heat pipes, respectively. And the first and second inlets 171" are formed on an outer circumferential surface of a lower side of the heater case 171*a*, and are connected to another ends of the first and second heat pipes, respectively.

The heater 171*b* includes an active heating portion 171*b'* configured to emit heat actively, and a passive heating portion 171*b"* provided below the active heating portion 171*b'*. And the active heating portion 171*b'* and the passive heating portion 171*b"* are accommodated in the heater case 171*a*, and are extended in a lengthwise direction of the heater case 171*a*. That is, in the heater case 171*a*, the active heating portion 171*b'* is positioned at an upper side, and the passive heating portion 171*b"* is positioned at a lower side.

When all of the working fluid (F) inside the heat pipe 172 is in a liquid state as the defroster 170 is not operated, a height of the surface of the working fluid (F) filled in the heating unit 171 is higher than a height of an uppermost end of the active heating portion 171*b'*. This configuration is to prevent the active heating portion 171*b'* from being overheated.

The first and second outlets 171' of the heater case 171*a* are formed on an outer circumferential surface of the heater case 171*a* which encloses the active heating portion 171*b'*, and the first and second inlets 171" of the heater case 171*a* are formed on an outer circumferential surface of the heater case 171*a* which encloses the passive heating portion 171*b"*. Under such a structure, the cooled working fluid (F) introduced through the first and second inlets 171" is introduced into the passive heating portion 171*b"*. Then, the working fluid (F) is re-heated by the active heating portion 171*b"*, and is discharged out through the first and second outlets 171'.

The heat pipe 172 connected to the first and second outlets 171' of the heater case 171*a* is vertically extended towards an upper side of the evaporator 130, and then is extended to a lower side of the evaporator 130 by being repeatedly bent in a zigzag form in correspondence to the cooling pipe 131 of the evaporator 130.

Since the working fluid (F) is gradually cooled by being heat-exchanged with the cooling pipe 131 of the evaporator 130, the heat pipe 172 before the working fluid (F) is introduced into the first and second inlets 171" of the heater case 171*a* may have a predetermined temperature lower than a temperature where defrosting can be performed.

Considering this, the heat pipe 172 is configured to further include at least two horizontal pipes 172' disposed below a lowermost-row cooling pipe 131' of the evaporator 130, such that only the heat pipe 172 of a high temperature is used to defrost the evaporator 130. In this embodiment, illustrated is a structure that the heat pipe 172 is formed by further including two rows below the lowermost-row cooling pipe 131' of the evaporator 130.

The supporting plates 133 provided at both sides of the evaporator 130 may be extended to a position below the lowermost-row cooling pipe 131', thereby fixing and supporting the at least two horizontal pipes 172' disposed below the lowermost-row cooling pipe 131' of the evaporator 130.

Hereinafter, other embodiments of the defroster according to the present invention will be explained. The same or equivalent components as those in the aforementioned embodiment will be provided with the same reference numbers, and description thereof will not be repeated.

Figure 5:
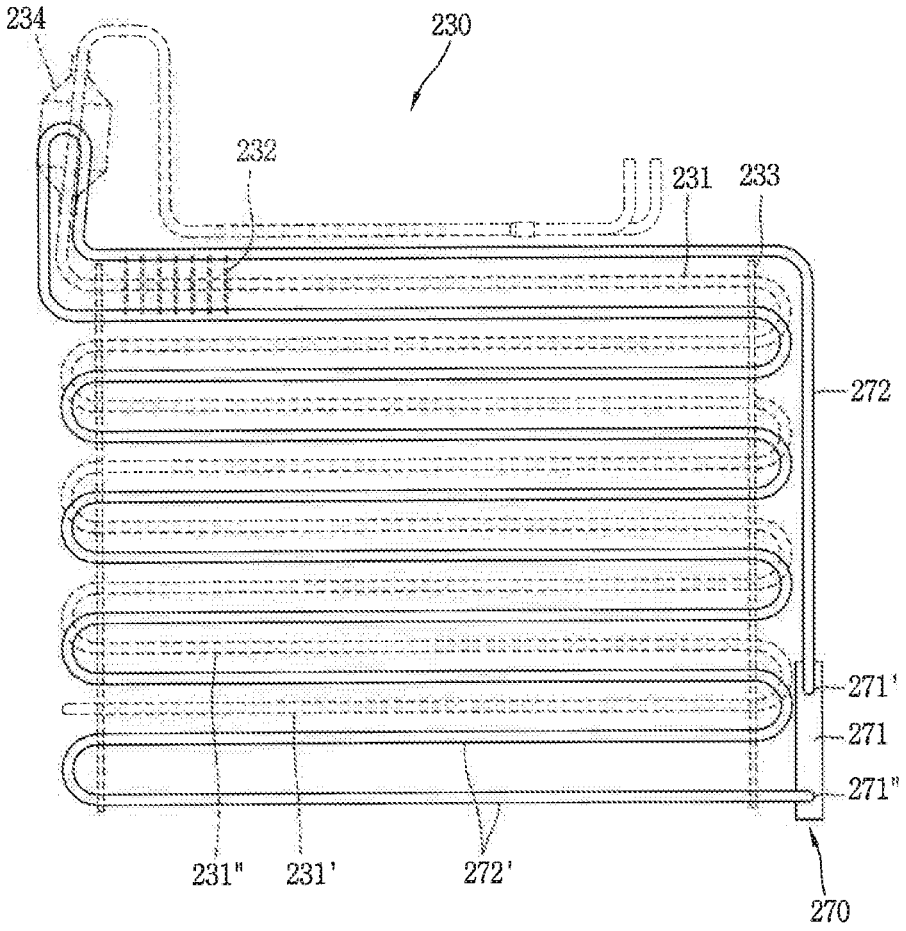
FIG. 5 is a view conceptually showing a second embodiment of the defroster applied to the refrigerator of FIG. 1.
Figure 6:
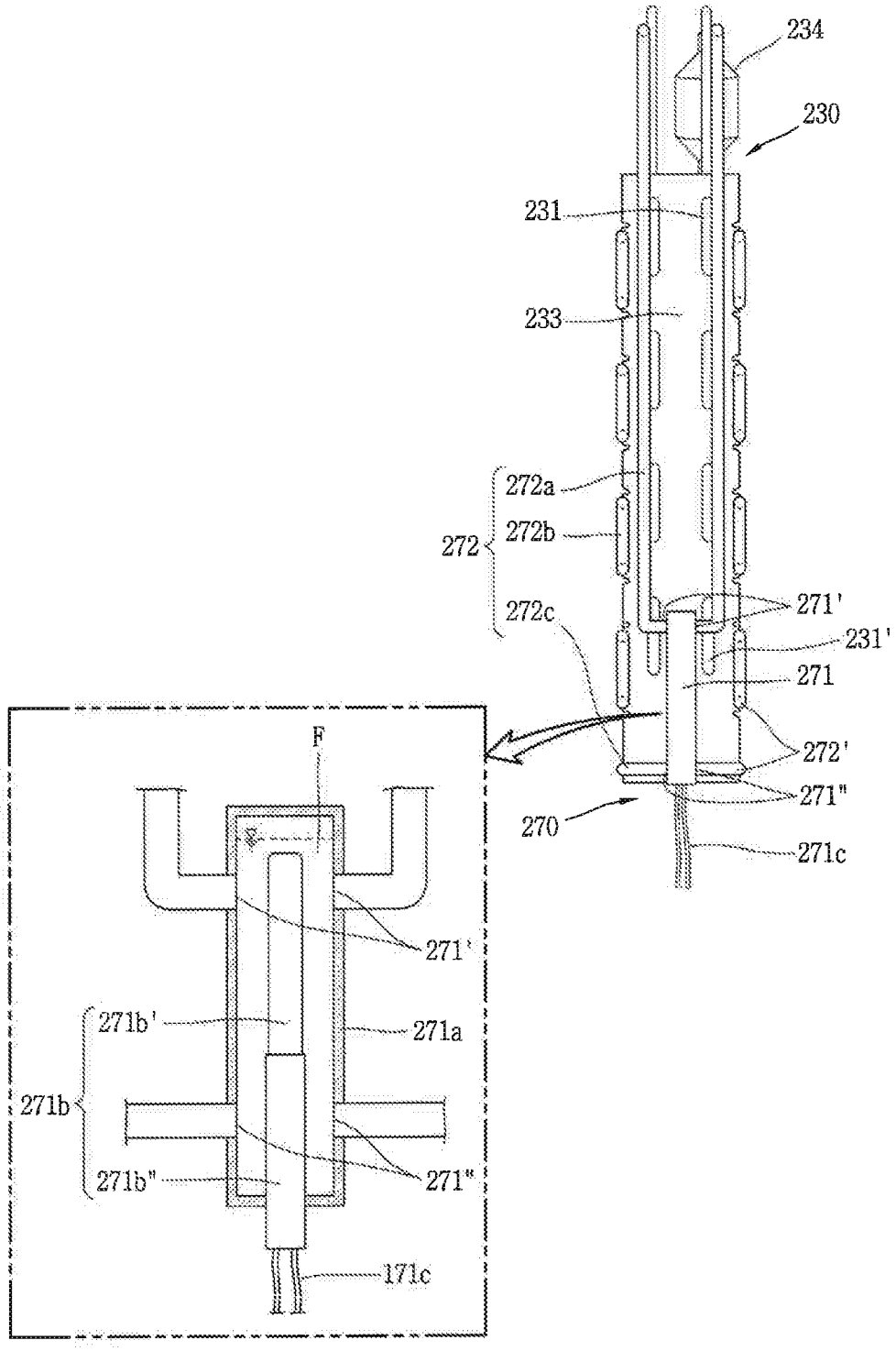
FIG. 6 is a view showing one side of the defroster shown in FIG. 5.
Figure 7:
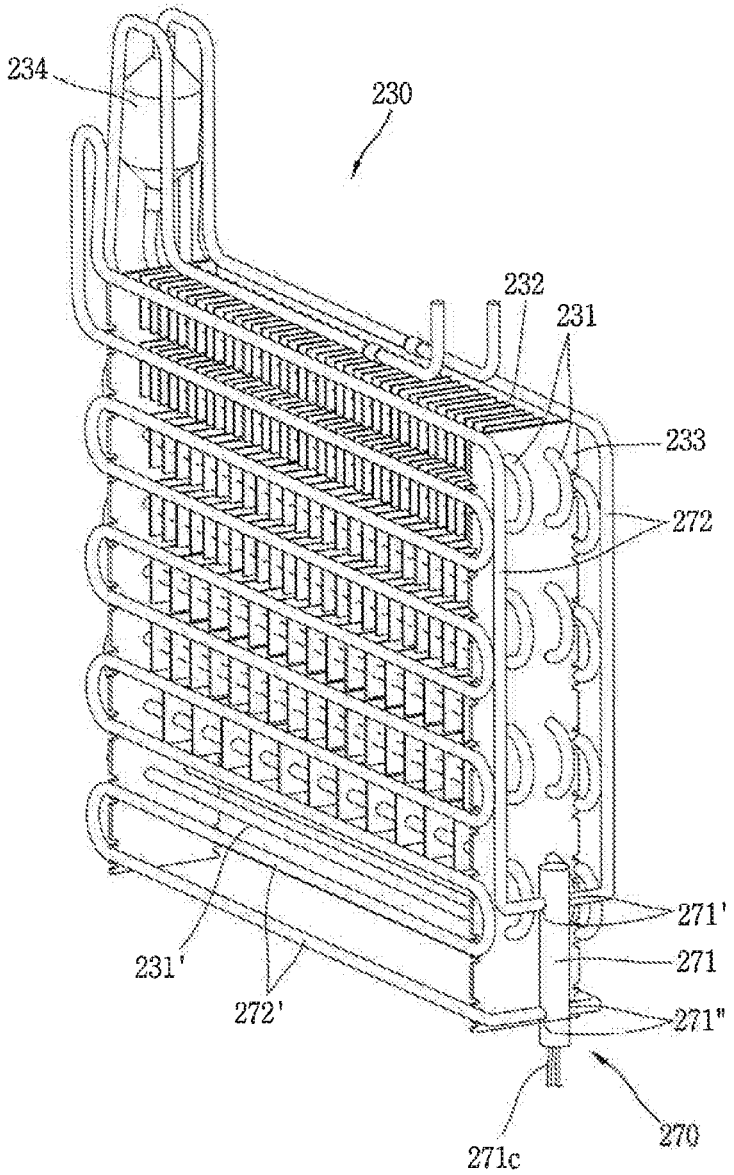
FIG. 7 is a view showing a detailed embodiment of the defroster shown in FIG. 5.

FIG. 5 is a view conceptually showing a second embodiment of a defroster 270 applied to the refrigerator 100 of FIG. 1. FIG. 6 is a view showing one side of the defroster 270 shown in FIG. 5. And FIG. 7 is a view showing a detailed embodiment of the defroster 270 shown in FIG. 5.

Referring to FIGS. 5 and 6, a heating unit 271 includes a heater case 271*a* vertically arranged outside an evaporator 230 in an up-down direction, and a heater 271*b* extended in the heater case 271*a* in a lengthwise direction of the heater case 271*a*. That is, the heater 271*b* is vertically arranged in an up-down direction of the evaporator 230.

Under the above structure, when all of a working fluid (F) inside a heat pipe 272 is in a liquid state, the heater 271*b* is positioned below the surface of the working fluid (F).

An outlet 271' for discharging the working fluid (F) heated by the heater 271*b* is formed at an upper side of the heater case 271*a*. And an inlet 271" for introducing the working fluid (F) cooled through a heat exchange with a cooling pipe 231 of the evaporator 230, is formed at a lower side of the heater case 271*a*.

The heater 271*b* is categorized into an active heating portion 271*b'* and a passive heating portion 271*b"* according to whether it emits heat actively or passively. The active heating portion 271*b'* is heated to a high temperature to evaporate the working fluid (F). And the passive heating portion 271*b"* provided below the active heating portion 271*b'* is heated to a low temperature by receiving heat from the active heating portion 271*b'*. However, the passive heating portion 271*b"* does not have a high temperature high enough to evaporate the working fluid (F).

The heater 271*b* corresponding to the inlet 271" for introducing the working fluid (F) is formed as the passive heating portion 271*b"*, and the active heating portion 271*b'* is upward extended from the passive heating portion 271*b"*. That is, since the working fluid (F) which returns to the inlet 271" of the heating unit 271 is introduced to the active heating portion 271*b'* via the passive heating portion 271*b"*, the working fluid (F) is not immediately re-heated. This may prevent a backflow of the working fluid (F).

The heat pipe 272 is connected to each of the outlet 271' and the inlet 271" of the heater case 271*a*. And at least part of the heat pipe 272 is arranged near the cooling pipe 231 of the evaporator 230, such that the working fluid (F) is heat-exchanged with the cooling pipe 231 of the evaporator 230.

That is, the high-temperature working fluid (F) of a gaseous state, heated by the active heating portion 271*b'* is transferred to the heat pipe 272 through the outlet 271'. And the working fluid (F) undergoes a phase change through a heat exchange while flowing along the heat pipe 272, thereby being cooled to a liquid state. Then, the working fluid (F) is collected to the passive heating portion 271*b*" through the inlet 271", and then is re-heated by the active heating portion 271*b*' to thus be supplied. That is, the working fluid (F) is implemented to form a circulation loop.

The heat pipe 272 includes at least two horizontal pipes 272' disposed below a lowermost-row cooling pipe 231' of the evaporator 230. FIG. 5 shows that a part of the heat pipe 272 is further provided with two rows below the lowermost-row cooling pipe 231' of the evaporator 230.

Under such a structure, a part of the heating unit 271 is arranged below the lowermost-row cooling pipe 231' of the evaporator 230. For instance, a lower end of the heating unit 271 may be positioned near a lowermost-row horizontal pipe of the heat pipe 272. And an upper end of the heating unit 271 may be positioned below a cooling pipe 231" formed directly above the lowermost-row cooling pipe 231' of the evaporator 230 (i.e., the second cooling pipe from the lower side).

In this case, a return part 272*c* for connecting the lowermost-row horizontal pipe of the heat pipe 272 with the inlet 271" of the heating unit 271 is formed to have a shorter length than the return part in the first embodiment.

If the lowermost-row horizontal pipe of the heat pipe 272 and the inlet 271" of the heating unit 271 are arranged on the same layer, the return part 272*c* may be extended from the lowermost-row horizontal pipe of the heat pipe 272 in a bent manner in a horizontal direction, and may be connected to the inlet 271" of the heating unit 271. Alternatively, the lowermost-row horizontal pipe of the heat pipe 272 may be directly connected to the inlet 271" of the heating unit 271 without the return part.

In the second embodiment, since the heating unit 271 is arranged near the lowermost-row horizontal pipe of the heat pipe 272, the heater 271*b* may be immersed below the surface of the smaller amount of working fluid (F) than the working fluid (F) in the first embodiment. Further, as the amount of the working fluid (F) is reduced, a temperature of the lowermost-row horizontal pipe of the heat pipe 272 may be increased to a value where defrosting can be performed. That is, the heat pipe 272 may entirely have a value more than a temperature where defrosting can be performed.

As a result of an experiment, in the structure shown in FIG. 7, the working fluid (F) was filled by 30-40% with respect to a volume of the heat pipe 272. Accordingly, it was checked that the heat pipe 272 had entirely a value more than a temperature where defrosting can be performed, and a partial overheating of the heater 271*b* was prevented.

Figure 8:
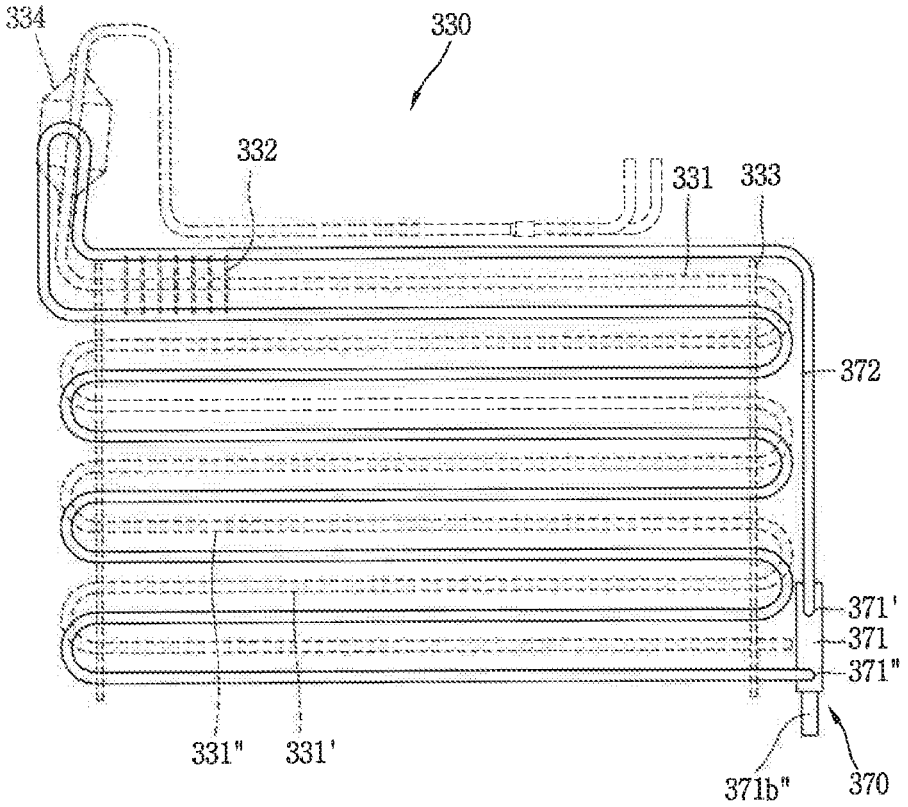
FIG. 8 is a view conceptually showing a third embodiment of the defroster applied to the refrigerator of FIG. 1.
Figure 9:
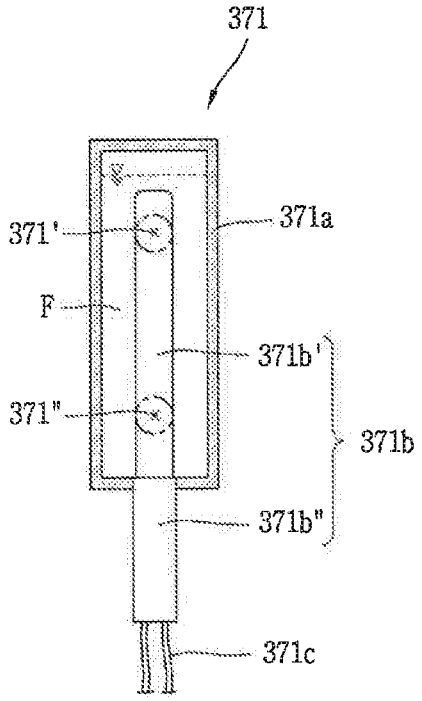
FIG. 9 is a sectional view of a heating unit shown in FIG. 8.
Figure 10:
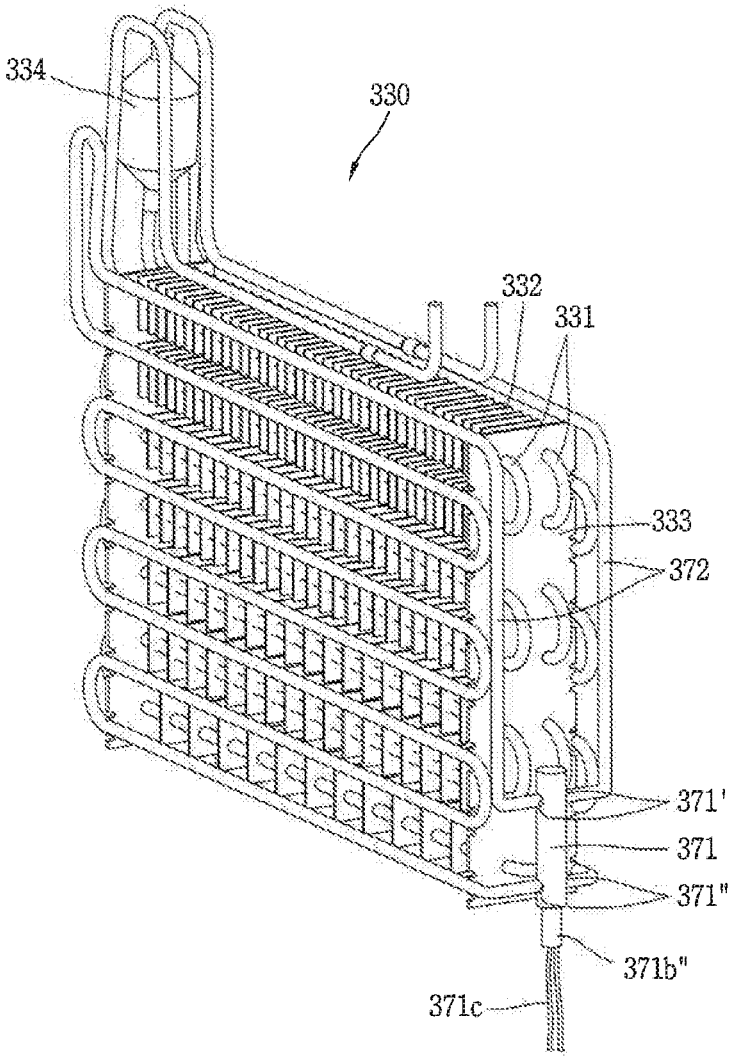
FIG. 10 is a view showing a detailed embodiment of the defroster shown in FIG. 8.

FIG. 8 is a view conceptually showing a third embodiment of a defroster 370 applied to the refrigerator of FIG. 1. FIG. 9 is a sectional view of a heating unit 371 shown in FIG. 8. And FIG. 10 is a view showing a detailed embodiment of the defroster 370 shown in FIG. 8.

Referring to FIGS. 8 and 9, the heating unit 371 includes a heater case 371*a* connected to both ends of the heat pipe 372 and forming a closed loop where a working fluid (F) can circulate, and a heater 371*b* configured to heat the working fluid (F). The heater 371*b* includes an active heating portion 371*b*' configured to emit heat actively so as to heat the working fluid (F), and a passive heating portion 371*b*" provided below the active heating portion 371*b*' and heated to a lower temperature than the active heating portion 371*b*'.

The heater case 371*a* is extended in one direction, and is arranged outside one supporting plate 333 in an up-down direction of an evaporator 330. An outlet 371' for discharging the working fluid (F) heated by the heater 371*b* is formed at an upper side of the heater case 371*a*. And an inlet 371" for introducing the working fluid (F) cooled through a heat exchange with a cooling pipe 331 of the evaporator 330, is formed at a lower side of the heater case 371*a*. The heat pipe 372 is connected to each of the outlet 371' and the inlet 371" of the heater case 371*a*. And at least part of the heat pipe 372 is arranged near the cooling pipe 331 of the evaporator 330, such that the working fluid (F) is heat-exchanged with the cooling pipe 331 of the evaporator 330.

In the structure where the heating unit 371 is arranged in an up-down direction of the evaporator 330, the outlet 371' and the inlet 371" are arranged up and down, which corresponds to well a characteristic that the heated working fluid (F) moves upward. Thus, the structure where the heating unit 371 is arranged in an up-down direction of the evaporator 330 may significantly prevent a backflow of the heated working fluid (F) to the inlet 371". Thus, since it is less required to form a low temperature part at the inlet 371" of the heating unit 371 to which the working fluid (F) returns, at least part of the passive heating portion 371*b*" of the heater 371*b* may be exposed to outside of the heater case 371*a*. In some cases, the heater 371*b* Inside the heater case 371*a* may be formed only as the active heating portion 371*b*', and the passive heating portion 371*b*" may be exposed to outside of the heater case 371*a*.

In the above structure, when all of the working fluid (F) inside the heat pipe 372 is in a liquid state, the active heating portion 371*b*' is configured to be immersed below the surface of the working fluid (F).

The passive heating portion 371*b*" exposed to outside of the heater case 371*a* is configured to lower a surface load of the heater 371*b* by emitting heat of the heater 371*b* to outside. If the surface load of the heater 371*b* is lowered, the heater 371*b* may have reliability by preventing its overheating, and a lifespan of the heater 371*b* may be prolonged.

In the structure, since the heater 371*b* accommodated in the heater case 371*a* has a short length, the heater case 371*a* may have a reduced length.

Further, if the heating unit 371 is arranged near a lowermost-row horizontal pipe of the heat pipe 372, the heater 371*b* may be immersed below the surface of the smaller amount of working fluid (F) than the working fluid (F) in the second embodiment. Further, as the amount of the working fluid (F) is reduced, a temperature of the lowermost-row horizontal pipe of the heat pipe 372 may be increased to a value where defrosting can be performed. That is, the heat pipe 372 may entirely have a value more than a temperature where defrosting can be performed.

As shown in FIG. 8, if the lowermost-row horizontal pipe of the heat pipe 372 is arranged near a lowermost-row cooling pipe 331' of the evaporator 330, the lowermost-row horizontal pipe of the heat pipe 372 has a temperature where defrosting can be performed. As a result, unlike the aforementioned first and second embodiments, it is not required to install the heat pipe 372 below the lowermost-row cooling pipe 331' of the evaporator 330 by at least two rows.

Further, in the above structure, an upper end of the heating unit 371 may be positioned below a cooling pipe 331" formed directly above the lowermost-row cooling pipe 331' of the evaporator 330 (i.e., the second cooling pipe from the lower side).

The inlet 371" of the heating unit 371 may be positioned to correspond to a lower part of the active heating portion 371*b*'. And the outlet 371' of the heating unit 371, disposed above the inlet 371", may be positioned to correspond to an upper part of the active heating portion 371*b*', or may be positioned above the active heating portion 371*b*'.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. A defroster comprising:

a heating unit including a heater case vertically arranged outside of an evaporator in an up-down direction of the evaporator, and a heater vertically arranged in the heater case in the up-down direction at least partially; and a heat pipe that is connected to each of an outlet provided at an upper side of the heating unit and an inlet provided at a lower side of the heating unit, that is arranged near a cooling pipe of the evaporator at least partially, and that is configured to guide a working fluid heated by the heater to transfer heat to the evaporator for removal of frost, wherein, in a state in which all of the working fluid inside the heat pipe is in a liquid state, the heater is configured to be positioned below a surface of the working fluid, wherein the heater includes:

an active heating portion configured to emit heat to actively heat the working fluid, and a passive heating portion provided below the active heating portion and configured to be heated to a lower temperature than the active heating portion, and wherein the inlet of the heating unit is positioned to correspond to the passive heating portion to allow the working fluid returning along the heat pipe to be introduced into the passive heating portion.

2. The defroster of claim 1, wherein the outlet of the heating unit is positioned to correspond to the active heating portion, or is positioned above the active heating portion.

3. The defroster of claim 1, wherein the heat pipe includes:

an evaporation part connected to the outlet of the heating unit, and arranged to correspond to the cooling pipe of the evaporator to transfer heat to the cooling pipe of the evaporator; and a condensation part extended from the evaporation part, arranged below a lowermost-row cooling pipe of the evaporator, and connected to the inlet of the heating unit.

4. The defroster of claim 3, wherein the condensation part includes at least two horizontal pipes disposed below the lowermost-row cooling pipe of the evaporator.

5. The defroster of claim 4, wherein a lower end of the heating unit is arranged near the lowermost-row cooling pipe of the evaporator.

6. The defroster of claim 5, wherein the condensation part includes a return part upward extended from a lowermost-row horizontal pipe of the condensation part to the inlet of the heating unit.

7. The defroster of claim 4, wherein a lower part of the heating unit is arranged below the lowermost-row cooling pipe of the evaporator.

8. The defroster of claim 7, wherein a lower end of the heating unit is arranged near a lowermost-row horizontal pipe of the condensation part.

9. The defroster of claim 8, wherein an upper end of the heating unit is positioned below a cooling pipe formed directly above the lowermost-row cooling pipe of the evaporator.

10. The defroster of claim 1, wherein the heat pipe includes a lowermost-row horizontal pipe that is arranged near a lowermost-row cooling pipe of the evaporator, and wherein an upper end of the heating unit is positioned below a cooling pipe formed directly above the lowermost-row cooling pipe of the evaporator.

11. A defroster comprising:

a heating unit including a heater case vertically arranged outside of an evaporator in an up-down direction of the evaporator, and a heater vertically arranged in the heater case in the up-down direction at least partially; and a heat pipe that is connected to each of an outlet provided at an upper side of the heating unit and an inlet provided at a lower side of the heating unit, that is arranged near a cooling pipe of the evaporator at least partially, and that is configured to guide a working fluid heated by the heater to transfer heat to the evaporator for removal of frost, wherein, in a state in which all of the working fluid inside the heat pipe is in a liquid state, the heater is configured to be positioned below a surface of the working fluid, wherein the heat pipe comprises a lowermost-row horizontal pipe that is arranged near a lowermost-row cooling pipe of the evaporator, wherein an upper end of the heating unit is positioned below a cooling pipe disposed directly above the lowermost-row cooling pipe of the evaporator, wherein the heater includes an active heating portion configured to emit heat to actively heat the working fluid, and wherein the inlet of the heating unit is positioned to correspond to the active heating portion.

12. The defroster of claim 11, wherein the heater further includes a passive heating portion provided below the active heating portion and heated to a lower temperature than the active heating portion, and wherein at least part of the passive heating portion is positioned outside the heater case.

13. A defroster comprising:

a heating unit including a heater case vertically arranged outside of an evaporator in an up-down direction of the evaporator, and a heater vertically arranged in the heater case in the up-down direction at least partially; and a heat pipe that is connected to each of an outlet provided at an upper side of the heating unit and an inlet provided at a lower side of the heating unit, that is arranged near a cooling pipe of the evaporator at least partially, and that is configured to guide a working fluid heated by the heater to transfer heat to the evaporator for removal of frost, wherein the heat pipe includes:

an evaporation part connected to the outlet of the heating unit, and arranged to correspond to the cooling pipe of the evaporator to transfer heat to the cooling pipe of the evaporator, and a condensation part extended from the evaporation part, arranged below a lowermost-row cooling pipe of the evaporator, and connected to the inlet of the heating unit, wherein the heater includes:

an active heating portion configured to emit heat to actively heat the working fluid, and a passive heating portion provided below the active heating portion and heated to a lower temperature than the active heating portion, and wherein the inlet of the heating unit is positioned to correspond to the passive heating portion to allow the working fluid returning along the heat pipe to be introduced into the passive heating portion.

14. The defroster of claim 13, wherein the condensation part includes at least two horizontal pipes disposed below the lowermost-row cooling pipe of the evaporator.

15. The defroster of claim 14, wherein a lower end of the heating unit is arranged near the lowermost-row cooling pipe of the evaporator.

16. The defroster of claim 15, wherein the condensation part includes a return part upward extended from a lowermost-row horizontal pipe of the condensation part to the inlet of the heating unit.

17. The defroster of claim 14, wherein a lower part of the heating unit is arranged below the lowermost-row cooling pipe of the evaporator.

18. The defroster of claim 17, wherein a lower end of the heating unit is arranged near a lowermost-row horizontal pipe of the condensation part.

19. The defroster of claim 18, wherein an upper end of the heating unit is positioned below a cooling pipe formed directly above the lowermost-row cooling pipe of the evaporator.

* * * * *